US005479805A

United States Patent [19]

Koenen et al.

[11] Patent Number: 5,479,805

[45] Date of Patent: Jan. 2, 1996

[54] TWO-HIGH CROSS ROLLING MILL WITH GUIDE DISKS

[75] Inventors: Paul Koenen, Krefeld; Manfred Hien, Mönchengladbach, both of Germany

[73] Assignee: Mannesmann Aktiengesellschaft, Düsseldorf, Germany

[21] Appl. No.: 213,625

[22] Filed: Mar. 15, 1994

[30] Foreign Application Priority Data

Mar. 15, 1993 [DE] Germany ..... 43 08 721.3

[51] Int. Cl.[6] ..... B21B 19/04

[52] U.S. Cl. ..... 72/97; 72/95

[58] Field of Search ..... 72/95, 96, 97, 72/237, 245

[56] References Cited

U.S. PATENT DOCUMENTS 3,845,646 11/1974 Bellmann ..... 72/96
4,453,393 6/1984 Hino et al. ..... 72/245

FOREIGN PATENT DOCUMENTS 3644780 4/1988 Germany .
27108 2/1986 Japan ..... 72/97
267006 11/1987 Japan ..... 72/95
63-90306 4/1988 Japan .

*Primary Examiner*—Lowell A. Larson
*Attorney, Agent, or Firm*—Cohen, Pontani, Lieberman, Pavane

[57] ABSTRACT

A two-high cross rolling mill with driven rolls situated one above the other and a pair of rotatably driven guide disks which are supported in rockers which are swivelable around vertical axles and can be adjusted transversely to the swivel axis of the rockers. To optimize the adjusting time and adjusting accuracy, each of the two bearing members of each guide disk is arranged in a vertically adjustable chock so as to be swivelable around a horizontal axis extending transversely to the rolling direction. Each chock is fastened in turn in a clampable manner in a bearing slide which is adjustable in the direction of these swivel axes in horizontal planes and arranged in each instance in fitted guides which are guided in the rockers so as to be displaceable parallel to the rolling direction independently from one another.

9 Claims, 3 Drawing Sheets

TWO-HIGH CROSS ROLLING MILL WITH GUIDE DISKS

BACKGROUND OF THE INVENTION

1. Field of the Invention

The invention is directed to a two-high cross rolling mill with driven rolls situated one above the other and a pair of rotatably driven guide disks which are supported on the roll stand on both sides around vertical axles which may be adjusted with respect to inclination in bearing members arranged in rockers which are swivelable around vertical axles toward one side, and the guide disks can be adjusted transversely to the swivel axis of the rockers. Such a rolling mill is disclosed in DE 36 44 780 C1.

2. Description of the Prior Art

The guide disks of the generic two-high cross rolling mill close the lateral roll gap between the upper and lower taper roll as "rotating straight-edges". They participate in the rolling process and in so doing are exposed to peripheral forces in the radial, tangential and axial directions. They are subject to varying levels of extensive wear and must therefore be adjustable as well as exchangeable.

In order to change the disks, the rockers in which the guide disks are supported at both sides are swiveled out so that after loosening the fastening means the disks can be removed, generally by means of a crane.

In the operating state, the rockers are clamped with the guide disks at the frame or stand by means of clamping devices in the form of piston-cylinder units or levers.

The forces mentioned above which act in various planes cause wear which may be compensated for to a certain extent. For this purpose, the spatial position of the known guide disks can be changed, e.g. by means of inserts or shims, or can be adjusted transversely to the swivel axis of the rockers by means of an eccentric support of the swivel axles. The adjustment of the position of the guide disks is usually carried out manually during stopping periods and is accordingly time-consuming. Its precision depends upon the skill of the person carrying out the adjustment.

Another problem in known rolling mills is that the guide disks should be capable of diagonal adjustment for improved guidance of the hollow ingot which expands appreciably in the region of the long run-out taper of the rolls. Although the reference forming the generic type, DE 36 44 780 C1, offers no solution to this problem, it is known e.g., from the Japanese Laid Open Application 63-090306, to swivel the entire guide disk on a fastening device similar to a rotating disk. This solution is very costly.

SUMMARY OF THE PRESENT INVENTION

Accordingly, it is an object of the present invention to provide a two-high cross rolling mill with guide disks in which the guide disks can be adjusted in all planes and swiveled in an inclined position relative to the rolling direction automatically with reliably operating and stable means. This means that the adjusting time and adjusting accuracy are optimized and that guide disks which are worn or must be exchanged can be changed in a simple manner.

Pursuant to this object and others which will become apparent hereafter, one aspect of the present invention resides in each of the two bearing members of each guide disk being arranged in a vertically adjustable insert or chock so as to be swivelable around a horizontal axis extending transversely to the rolling direction. Each chock is fastened in turn in a clampable manner in a bearing slide which is adjustable in the direction of the swivel axes in horizontal planes and arranged in each instance in insert guides or fitted guides which are guided so as to be independently displaceable in the rockers parallel to the rolling direction.

As a result of the supporting of these guide disks with their bearing members in chocks, bearing slides and fitted guides which are displaceable relative to one another in different directions, all required adjustments of the guide disks can be accomplished. Thus, by displacing the bearing slides, the roll gap can be adjusted relative to the roll and the adjusted roll pass can be adapted to the deformation of the rolling stock.

The displacement of the vertically adjustable chock in the vertical plane serves to compensate for the extent of after-adjustment of the roll pass or for the deviation from the roll gap; the roll geometry in the roll gap is corrected or adjusted by means of the horizontal adjustment of the fitted guides in the rockers.

In order to maintain a small roll gap along the run-out taper of the rolls for as long as is needed, the guide disks are swiveled at an angle to the rolling direction by displacing the upper and lower fitted guides in opposite directions. The axle of the guide disk is accordingly swiveled and the bearing members lie obliquely in the chocks. The entire device may be automated by effecting the displacement of the chocks, bearing slides and fitted guides by means of controllable motors, cylinder units, spindles or the like.

To improve the stability of the two-high cross rolling mill and accordingly the rolling accuracy at a given adjustability of the guide disks, in another embodiment of the invention, the rockers are provided with formed parts which partially embrace the columns of the roll stand so as to contact them in a planar manner. These formed parts can be clamped with the columns in a positive engagement by means of known clamping elements. This proposal is based on the insight that a planar clamping of the rockers with the columns of the roll stand further improves the stability of the roll stand and a sliding of the contact surfaces relative to one another is prevented by the positively locking contact.

In a further embodiment of the invention the bearing slides for the chocks are open on one side in a U-shaped manner and the chocks, together with the guide disks, can be removed from the bearing slides when the rockers are swiveled up.

Whereas in the prior art the bilateral support of the guide disks is provided in recesses of the rockers, the bearing slides of the invention are designed so that the chocks along with the guide disks can be easily removed without affecting the adjustability. Accordingly, the guide disks may be changed quickly.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
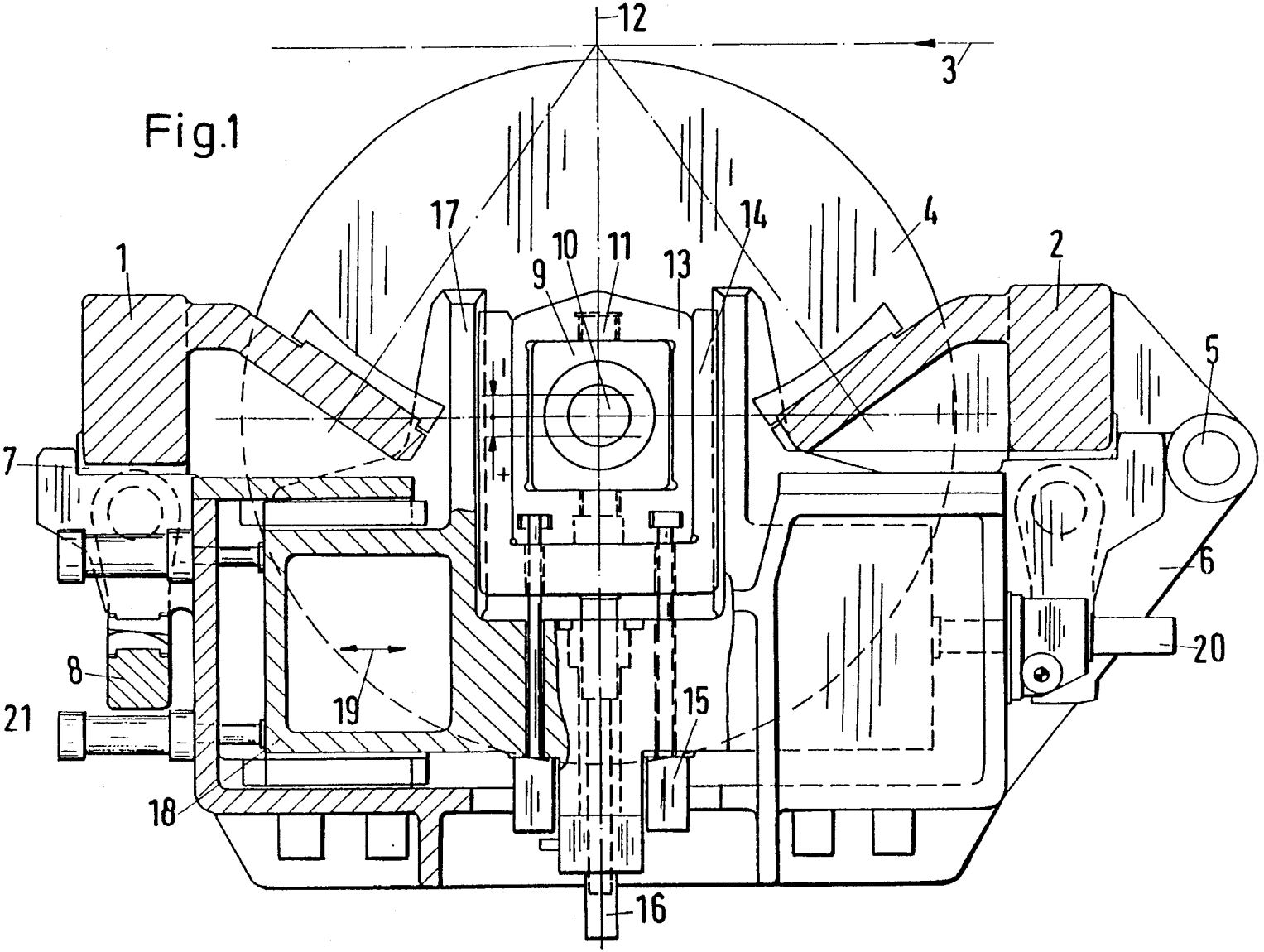
FIG. 1 shows a section through a side of a roll stand in the region of the support of the guide disks.

In FIG. 1, two columns of the two-high cross rolling mill according to the invention are designated by 1 and 2. The rolling direction of the pipe is indicated by 3 and the guide disk, whose circumference is shown in the drawing, is designated by 4. The rocker 6 which contacts the stand columns 1 and 2 in its working position is swivelable at the stand column 2 of the roll stand around a swivel pin 5. For this purpose, formed parts 7 in the form of angle plates are provided at the rocker 6 and partially embrace the stand columns 1 and 2 so as to clamp them, as is shown in the drawing.

The clamping levers, designated by 8, are provided for fastening the rocker 6 to the side remote of the swivel pin 5.

One of the two bearing members in which the pins 10 of the guide disk 4 are supported, e.g. in a spherical roller bearing, is shown at 9. The bearing member 9 is supported in turn by the pin 11 so as to be swivelable around the axis 12 in a chock 13 accommodated in the bearing slide 14. The bearing slide 14 forms a U-shaped receptacle for the chock 13 which is held in the bearing slide 14 via pull-back cylinders 15. The bearing slide 14 is adjustable in the axial direction 12 in guides 17 by means of a spindle lift device 16. The guides 17 are provided in a fitted guide 18. The fitted guide 18 is guided in the rocker 6 so as to be displaceable in the direction of arrow 19, displacement being effected by means of the spindle lift device 20 in opposition to the action of clamping cylinders 21 which ensure the absence of play in the system.

Figure 2:
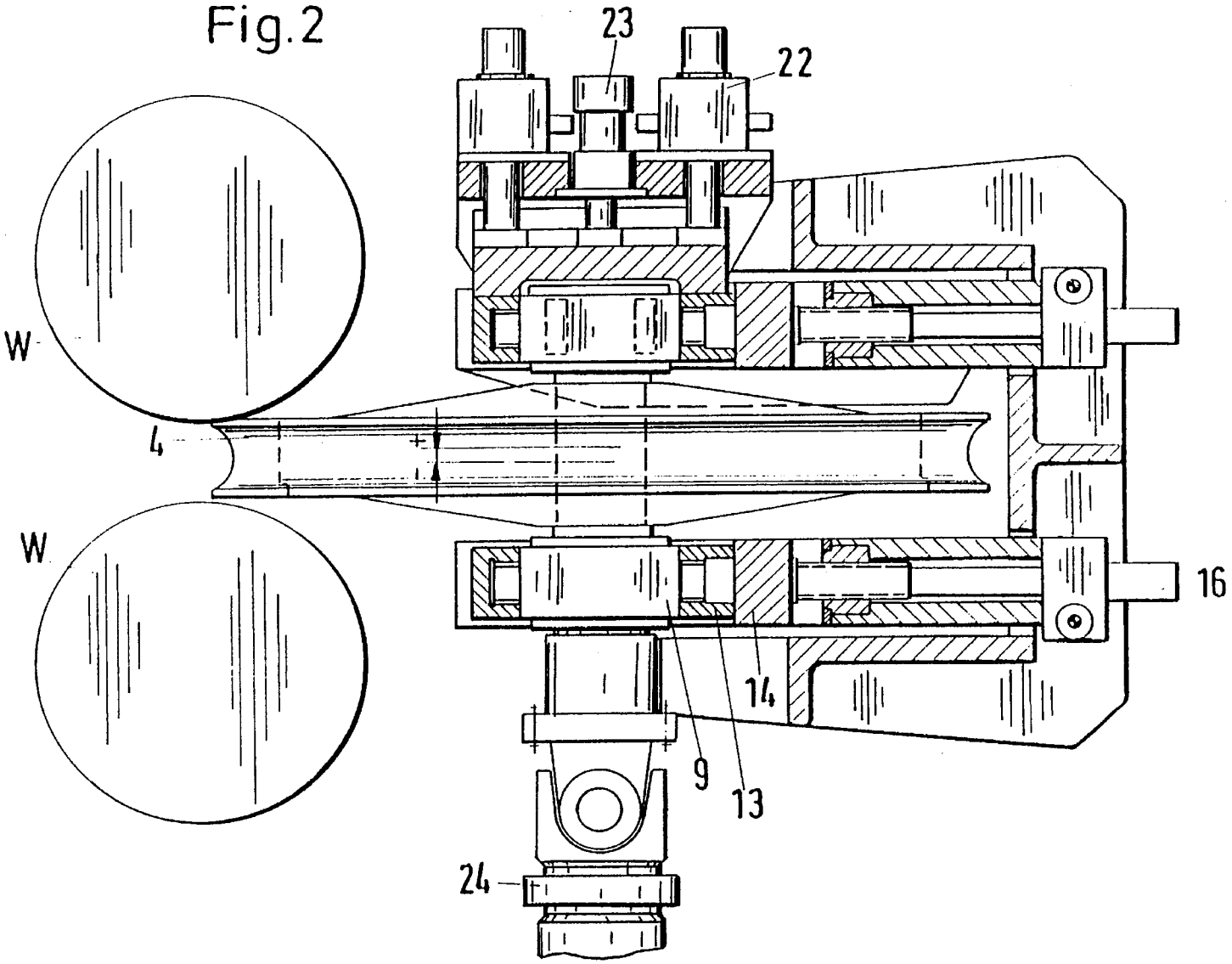
FIG. 2 shows a section through the support of the guide disks which is rotated 90° relative to FIG. 1.

Identical parts are designated by the same reference numbers in FIG. 2. The rolls W are also shown in a suggestive manner in this Figure. The guide disk 4 projects into the roll gap of the rolls W. FIG. 2 shows that the bearing members 9, the chocks 13 and the bearing slides 14 are provided on both sides of the guide disk 4 so that the guide disk 4 is supported bilaterally. It can also be seen that two spindle lift devices 16 are provided. These spindle lift devices 16 are operated synchronously for adjusting the guide disk 4 horizontally in the plane of projection.

It can also be seen that the chocks 13 are adjustable in the vertical direction via the spindles 22 and the pull-back cylinder 23, specifically the chocks at both sides of the guide disk 4 jointly. A corresponding compensation is provided in a known manner in the universal drive shaft indicated at 24.

Figure 3:
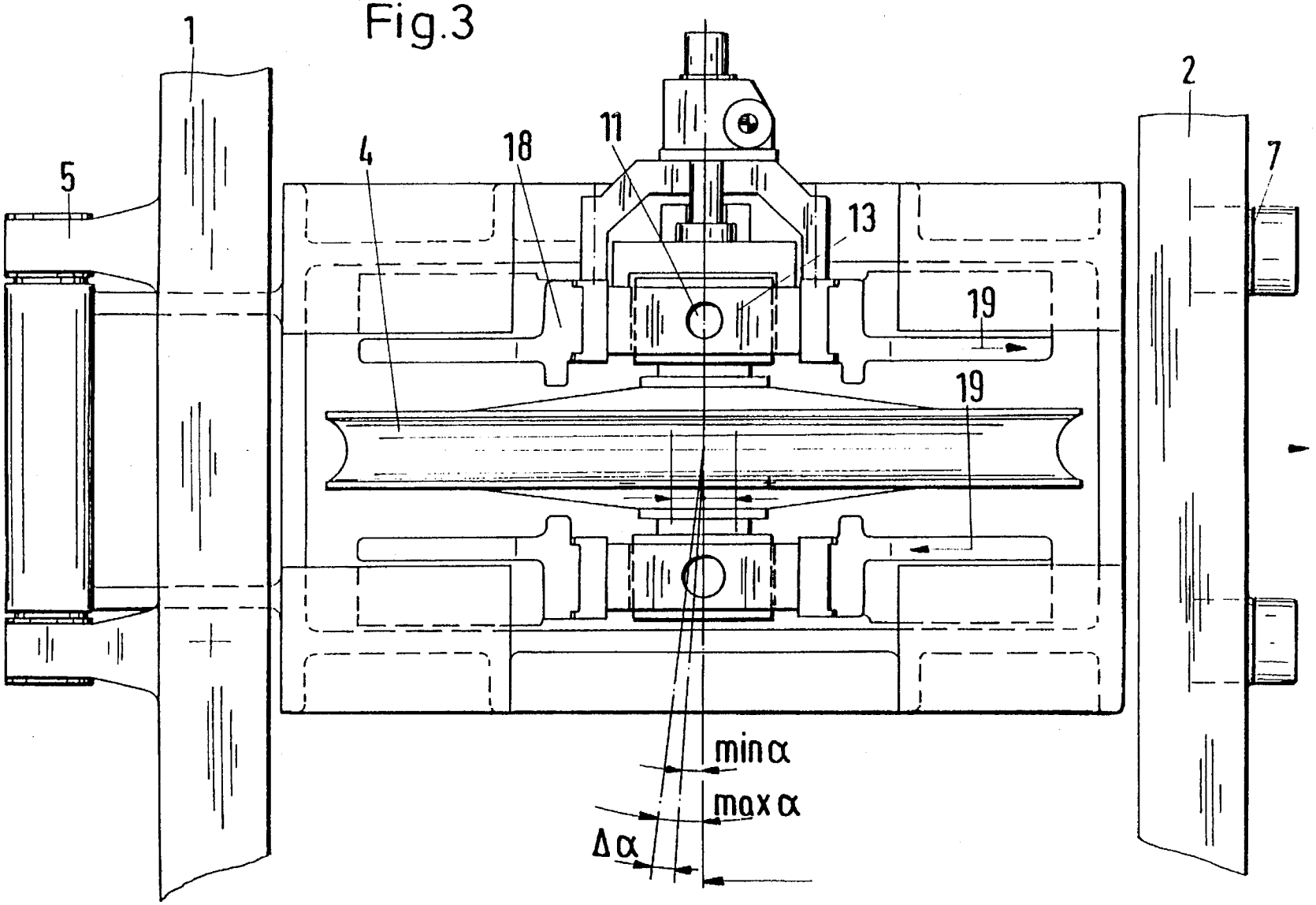
FIG. 3 shows a view of the roll stand, also rotated by 90°.

The oblique position of the guide disk 4 at an angle $\Delta\alpha$ is shown in FIG. 3. For this purpose, the fitted guides 18 above and below the guide disk 4 are adjusted in opposite directions 19 by means of the spindle lift device 20 (FIG. 1) so that the bearing members 9 of the guide disk 4 are arranged so as to be laterally offset relative to one another. In so doing, the bearing members 9 swivel around the pin 11 inside the chocks 13 and accordingly enable an inclination of the axis of the guide disk 4.

The invention is not limited by the embodiments described above which are presented as examples only but can be modified in various ways within the scope of protection defined by the appended patent claims.

We claim:

1. A two-high cross rolling mill, comprising: a roll stand; driven rolls having a rolling direction and being situated in the roll stand one above the other; a pair of rotatably driven guide disks each rotatable about an axis; rockers that are swivelable around vertical axles on one side of the roll stand; a bearing member on each side of each guide disk, the bearing members being arranged in the rockers; a plurality of vertically adjustable chocks, each of the two bearing members of each guide disk being arranged in one of the vertically adjustable chocks so as to be swivelable about a horizontal axis that extends transversely to the rolling direction; fitted guides arranged and guided in the rockers so as to be independently displaceable parallel to the rolling direction; and bearing slides that are adjustable in horizontal planes in the direction of the horizontal axis, one bearing slide being arranged in each one of the fitted guides and each chock being clamped in one of the bearing slides, whereby the fitted guides can be moved in opposite directions so as to tilt the rotational axes of the guide disks.

2. A two-high cross rolling mill according to claim 1, wherein the roll stand has two columns, the rockers being provided with formed parts which partially embrace the columns of the roll stand so as to contact the columns in a planar manner, and further comprising clamping means for clamping the formed parts with the columns in a positive engagement.

3. A two-high cross rolling mill according to claim 2, wherein the formed parts are angle plates.

4. A two-high cross rolling mill according to claim 1, wherein bearing slides for the chocks are U-shaped with one open side, the chocks, together with the guide disks, being removable from the bearing slides when the rocker is swiveled up.

5. A two-high cross rolling mill according to claim 2, and further comprising swivel pins for mounting the rockers to one of the columns of the stand.

6. A two-high cross rolling mill according to claim 5, wherein the clamping means includes clamping levers arranged on a side of the formed parts remote from the swivel pin.

7. A two-high cross rolling mill according to claim 1, and further comprising pull-back cylinder means for holding the chock in the bearing slide.

8. A two-high cross rolling mill according to claim 1, and further comprising spindle lift means for adjusting the bearing side in the axial direction.

9. A two-high cross rolling mill according to claim 1, and further comprising means for displacing the fitted guide in the rocker, the displacing means including a spindle lift device engaging one end of the fitted guide and a clamping cylinder engaging an opposite end of the fitted guide to take up play.

* * * * *